US010066328B2

(12) United States Patent
Janouschek et al.

(10) Patent No.: US 10,066,328 B2
(45) Date of Patent: Sep. 4, 2018

(54) LONG ARM QUILT AND LOCKSTITCH MACHINE ASSEMBLY

(71) Applicant: BERNINA International AG, Steckborn (CH)

(72) Inventors: Jan Janouschek, Winterthur (CH); Patric Konner, Konstanz (DE)

(73) Assignee: BERNINA INTERNATIONAL AG, Steckborn (CH)

( * ) Notice: Subject to any disclaimer, the term of this patent is extended or adjusted under 35 U.S.C. 154(b) by 0 days.

(21) Appl. No.: 15/416,297

(22) Filed: Jan. 26, 2017

(65) Prior Publication Data

US 2017/0275797 A1 Sep. 28, 2017

(30) Foreign Application Priority Data

Mar. 22, 2016 (CH) ..... 0393/16

(51) Int. Cl.
*D05B 11/00* (2006.01)
*D05B 69/36* (2006.01)

(52) U.S. Cl.
CPC ..... *D05B 11/00* (2013.01); *D05B 69/36* (2013.01)

(58) Field of Classification Search
CPC ..... D05B 11/00; D05B 21/00; D05B 69/36
See application file for complete search history.

(56) References Cited

U.S. PATENT DOCUMENTS

| | | | | |
|---|---|---|---|---|
| 3,329,109 | A | 7/1967 | Portnoff et al. | |
| 4,195,585 | A * | 4/1980 | Takahashi | D05B 69/36 112/277 |
| 4,490,656 | A * | 12/1984 | Arnold | H02P 25/145 112/275 |
| 6,363,872 | B1 * | 4/2002 | Heckner | D05B 69/125 112/220 |
| 6,883,446 | B2 * | 4/2005 | Koerner | D05B 19/14 112/272 |
| 6,990,914 | B2 * | 1/2006 | Canan | D05B 11/00 112/119 |
| 7,207,281 | B1 | 4/2007 | Kasa | |
| 9,869,043 | B2 * | 1/2018 | Spengler | D05B 11/00 |

FOREIGN PATENT DOCUMENTS

| | | |
|---|---|---|
| DE | 586298 | 10/1933 |
| JP | S5649687 | 5/1981 |
| KR | 20130091191 | 8/2013 |

* cited by examiner

*Primary Examiner* — Danny Worrell
(74) *Attorney, Agent, or Firm* — Volpe and Koenig, P.C.

(57) ABSTRACT

A long arm quilt and lockstitch machine assembly (1) having a framework having two rail tracks, disposed orthogonally on top of one another, wherein the sewing machine (19) is disposed so as to be displaceable on the rail track lying above. The connections between the drive belt (33, 43) to which the rail track (9) lying below and the sewing machine (19) are connected by way of an electronic control system via drive motors, include overload couplings which in the case of overloading by body parts or items of clothing that are caught between the movable elements separate the movable elements from the drive belts. Advantageously, the overload coupling is simultaneously a connection element and in the case of overloading separates the connection between the elements.

6 Claims, 10 Drawing Sheets

1
17
23
47
19
9
45
37
43
25
13
21
11
27
29
15
9
7
8
41
37
31
35
33
41
17
15
3
7
5
5
39

LONG ARM QUILT AND LOCKSTITCH MACHINE ASSEMBLY

INCORPORATION BY REFERENCE

The following documents are incorporated herein by reference as if fully set forth: Swiss Patent Application No. 00393/16, filed Mar. 22, 2016.

BACKGROUND

The invention is directed to a long arm quilt and lockstitch machine assembly.

In order for large-area quilts to be produced, long arm quilt machines or assemblies are known nowadays. These machines or assemblies as a baseline comprise a framework having two pairs of rail tracks, disposed orthogonally on top of one another, wherein the rail track lying above is displaceable on the rail track lying below in an orthogonal direction, and a sewing machine is placed on the upper rail track so as, for its part, to be displaceable. In the case of these systems, the sewing machine may be moved either manually in the X-direction and the Y-direction, that is to say that figures may be manually generated, or if and when the upper rail track and the sewing machine that is displaceable thereon each are drivable by motive power by way of one belt, then the movements of the sewing machine may alternatively be controlled by way of a machine controller by the use of a software program. It is thus possible for quilting to be fully automatically performed. It is thus also possible to produce the quilt in a completely automatic manner. Often, the quilt patterns are generated in a largely automatic manner, and hand-made patterns are inserted therebetween. For this purpose, the connections between the sewing machine and the motive drive thereof, and between the upper rail track and the motive drive thereof, must be separated. Separating or decoupling the connections, respectively, between the drive belts and the guide tracks, or separating or decoupling, respectively, the sewing machine from the guide tracks, is known from the prior art.

In the free-hand mode, that is to say in the case in which the sewing machine is completely decoupled from the travel drives, the drive belts are already stationary because decoupling is possible only in the resting state. There is no risk whatsoever to the female or male operator of the sewing machine of contacting driven rotating elements. In the case of the automatic mode in which the sewing machine is moved by two drive motors in the X-direction and the Y-direction, there is however the latent risk of the operator by way of a body part, for example a finger, a hand, the hair, or an item of clothing, to be caught by moving parts, or to be jammed between such moving parts, and to be injured. In the case of such incidents, parts of the long arm quilt and lockstitch machine assembly may also be compromised as a result of overloading.

SUMMARY

An object of the present invention is to achieve drive connections which during the automatic operation are connected, but in the case of overloading are separable in the case in which a stoppage of the machine has not already been initiated beforehand by way of an electrical monitoring system of the drive currents of the drive motors.

This object is achieved by a long arm quilt and lockstitch machine assembly according to one or more features of the invention, with advantageous design embodiments of the assembly being described below and in the claims.

By way of a mechanical interruption of the connections between the drive motors and the travel-capable elements of the machine assembly, triggered by overloading, it is ensured by a coupling element that any risk of injury to the operator and/or any destruction of mechanical parts of the system are/is precluded. Not only the travel-capable elements of the drive assembly are deactivated by the coupling element on the take-off side of the drive motors, but also the drive belts that emanate from the motors and lead to these travel-capable elements. In the case of the use of coupling elements directly on the connection locations between the drive belt and the travel-capable elements of the drive assembly, the separation is performed on location, the overload being capable of being set. It is also prevented herein that parts, such as fingers or hairs, that engage in the travel path of the travel-capable elements (sewing machine and upper travel track) are damaged.

It may be advantageously achieved that at the same time the mechanical connection between the travel-capable parts and the drive motor and simultaneously the overload coupling are unified in one single element by way of the coupling elements on the drive belts. The construction of these coupling elements is manufacturable in a cost-effective manner and, due to the simple construction, is also reliable in terms of the functioning thereof. Further, the arrangement of the coupling on the belt is particularly advantageous because, on account thereof, the travel-capable elements following the manual release of the coupling may be moved by hand almost without resistance, or that parts, such as hairs or items of clothing, that may have already been caught between the rollers or other elements may be immediately removed without damage.

The coupling may furthermore also be manually opened, so as to be switched from the automatic mode to the manual mode in which the sewing machine is moved by hand.

In the case of an arrangement of an overload coupling directly on or next to the drive motors it is advantageous for the belts to be also immediately deactivated in the case of overloading. Such a coupling may be disposed additionally to the coupling between belts and travel-capable elements, or the connection between the belts and the travel-capable elements in the connection region has likewise to be provided with a coupling in order to be able to switch from the automatic mode to the manual mode without the belts continuing to be moved, respectively. The second mentioned embodiment of the invention is thus particularly suitable for retrofitting to systems which are already in operation and are provided with an overload coupling in addition to the couplings that are to be manually operated.

BRIEF DESCRIPTION OF THE DRAWINGS

The invention will be explained in more detail by means of exemplary embodiments. In the figures.

DETAILED DESCRIPTION OF THE PREFERRED EMBODIMENTS

Figure 1:
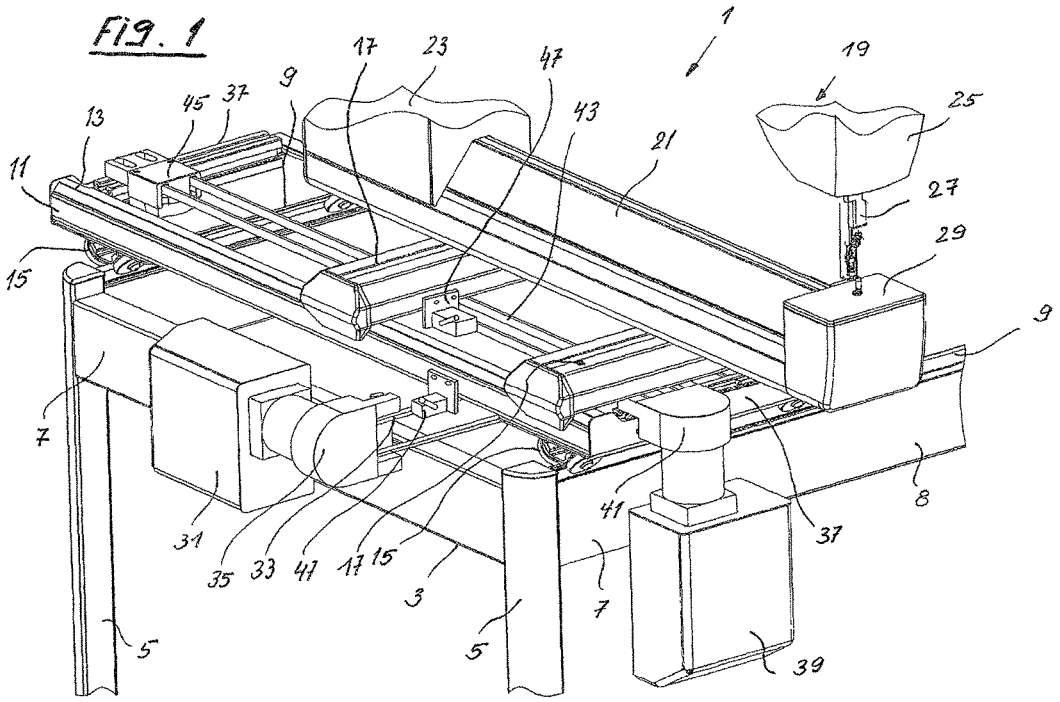
FIG. 1 shows a perspective partial view of a long arm quilt and lockstitch machine assembly.

A long arm quilt and lockstitch machine assembly, hereunder referred to as the machine assembly for short, is illustrated having the reference sign 1. This machine assembly comprises a base framework 3 having four support legs 5 of which only the two laterally disposed support legs 5 are visible. The support legs 5 in the region of the upper ends thereof are fixedly interconnected by four horizontal profiled elements 7, forming a rectangular lower guide frame 8. Lower rail tracks 9 on which an upper rectangular guide frame 11 having two upper rail tracks 13 is placed so as to be capable of travel are placed on two of the profiled elements 7 that lie so as to be parallel and mutually opposite. Four suitable rollers or roller pairs 15 which roll along the lower rail tracks 9 are rotatably mounted on the upper guide frame 11.

A long arm sewing machine 19 is mounted displaceably on the upper rail tracks 13, on two supports 17 that lie parallel and bridge the upper rail tracks 13. Of the sewing machine 19, the arm bed 21, the machine pedestal 23, and in portions the head 25 having the needle bar 27 are visible. The needle-hole plate 29 lies below the needle bar 27 having the needle, so as to be at the end of the arm bed. The two supports 17 are mounted by means of rollers or roller pairs (rollers not illustrated) that roll along the upper rail tracks 13.

A first drive device 31 for driving the upper guide frame 11 of the upper rail tracks 13 on the lower rail tracks 9 is fastened to one of the profiled elements 7. The drive device, preferably an electric motor 31, on the take-off side has a belt pulley or sprocket 75 on which an endless belt 33 revolves. The belt pulley 75 is protected by a protective cover 35 and is therefore not visible in FIG. 1, but will be in FIGS. 5 and 6. A flat belt, a timing belt, or a perforated steel band may be employed as a first belt 33. A coupling 47 between the first belt 33 and the upper guide frame 11 is visible as a schematically represented cuboid in FIG. 1 and will be described in detail at a later stage.

In a manner analogous to the drive of the upper guide frame 11, a second drive motor 39 having a take-off side belt pulley 75 under a covering hood 41 is disposed on the profile 37 that connects the two upper rail tracks 13 at the end sides. An upper belt 43 which at the profile 37 at the opposite end side revolves on a redirection disk that is fastened to said profile 37 is guided over the take-off side belt pulley 75. The belt pulley 75 is disposed under a safety cover 41. One of the belt leads of the upper belt 43 on one of the two supports 17 is releasably fastened to a coupling 47. The coupling 47 is illustrated as a cuboid in FIG. 1.

Figure 2:
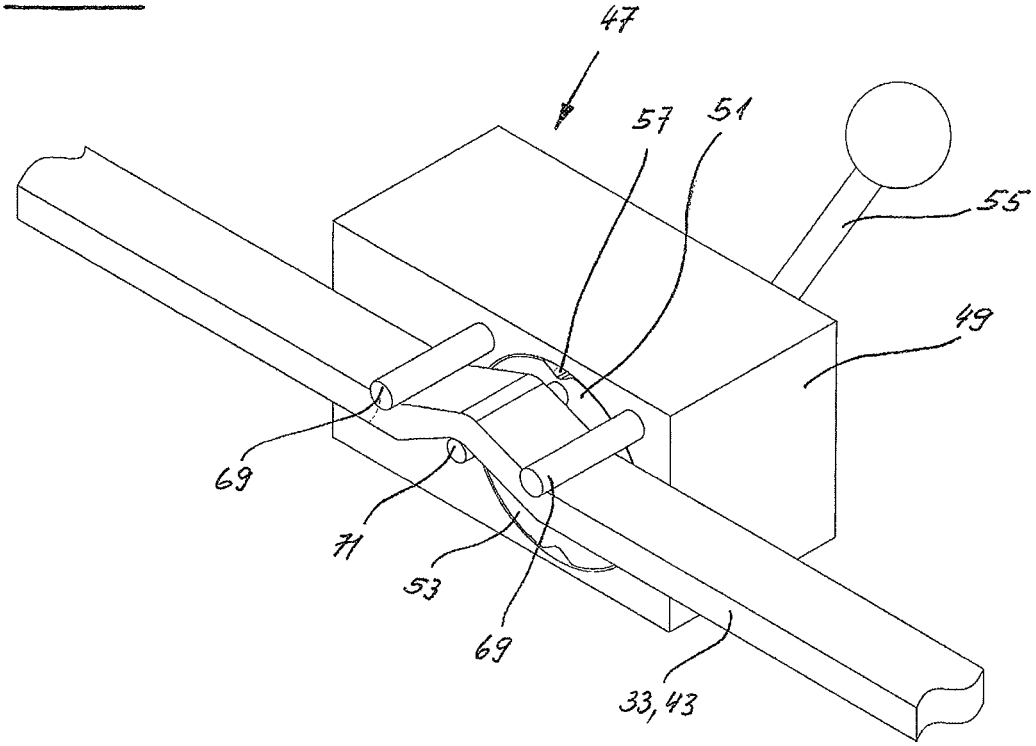
FIG. 2 shows a perspective illustration of a belt overload coupling and blocking device (engaged)
Figure 3:
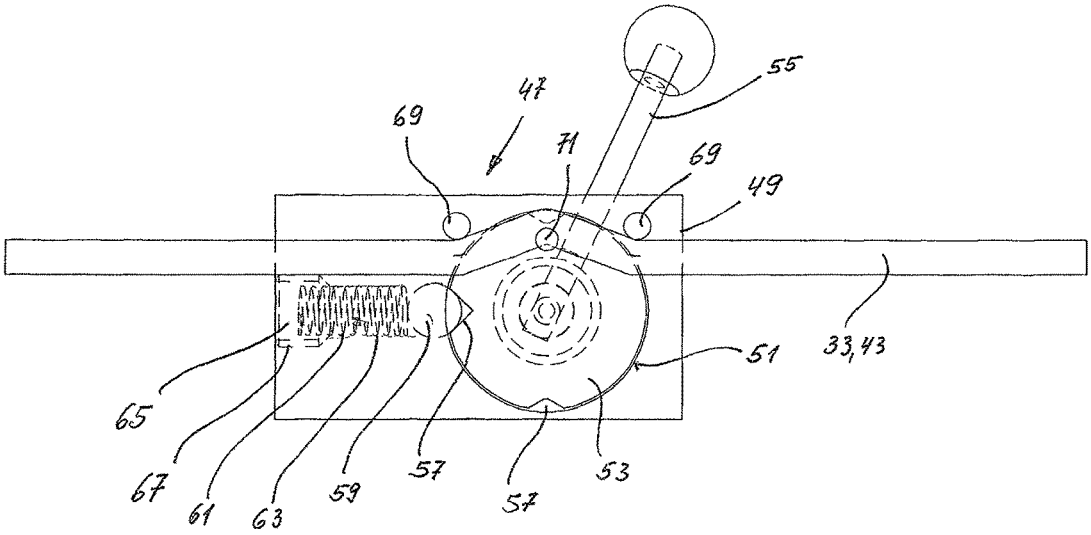
FIG. 3 shows a front view of the belt overload coupling and blocking device (engaged)
Figure 4:
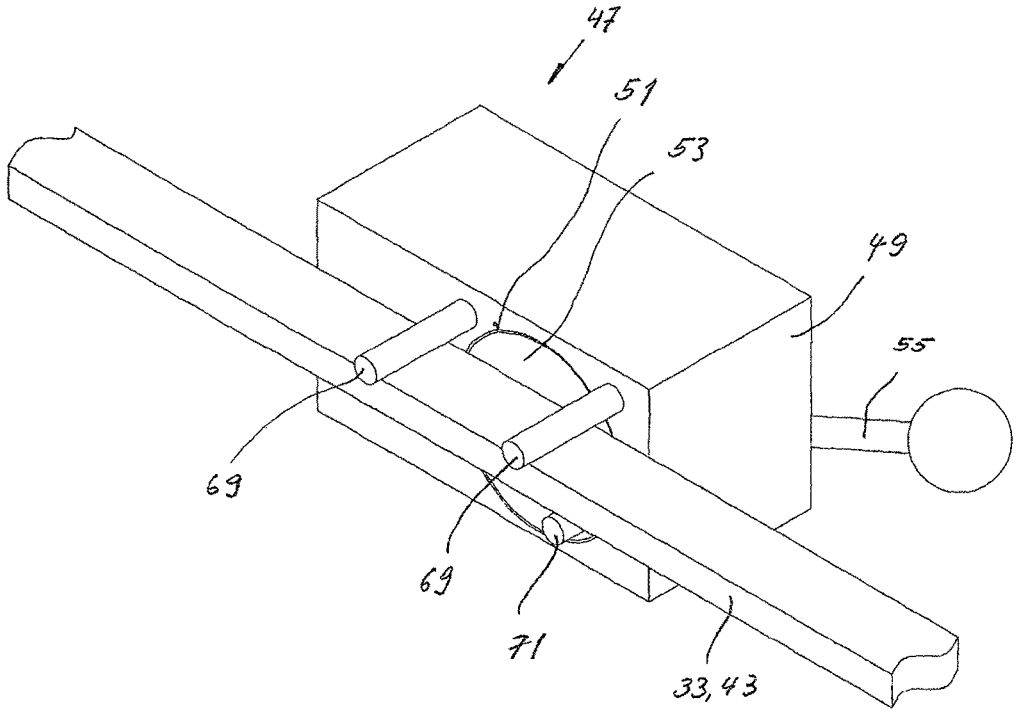
FIG. 4 shows a perspective view of the belt overload coupling and blocking device (disengaged)

In FIGS. 2 to 4, the coupling 47 is illustrated so as to be released from the machine assembly 1. Said coupling 47 comprises a cuboid housing 49 which is configured so as to be connectable to the support 17 or to the upper guide frame 11, respectively. A cylindrical disk 53 is mounted so as to be rotatable with slight play in a cylindrical bore 51 in the housing 49. An activation lever 55 for rotating the disk 53 is fastened to the aft end face of the disk 53. At least one axially running groove 57 is configured in the shell face of the disk 53 (cf. also FIGS. 2 and 3). A ball 59 that is impinged with an axially acting spring tension, or a cylinder that is provided with a semi-spherically shaped end (not illustrated), engages in one of the grooves 57. The ball 59 and the spring 61 that in FIG. 1 pushes the former to the right are guided in a guide bore 63 in the housing 49. The tension of the spring 61 and thus the compressive force of the ball 59 that acts on the groove 57 may be set by way of a set screw 65 which is guided in a threaded portion 67 in the guide bore 63.

Two guide pins 69 protrude from the forward end face of the housing 49. A retaining pin 71 which is fastened to the forward end face of the disk 53 deflects the belt 33 or 43, respectively, which from above is supported by the two guide pins 69, from below toward the top, because the axes of the three pins 69, 71 lie in approximately one plane. Depending on the configuration of the belts 33 or 43, respectively, as flat belts or as timing belts, the vertical offset of the pins 69 in relation to the retaining pin 71 is larger or smaller. Should the lower retaining pin 71 bear on the disk 53 between two teeth of a belt 33, 43 that is designed as a timing belt, then the offset in terms of height is to be chosen to be smaller than in the case of a flat belt in order for approximately the same retaining forces of the belt 33, 43 on the coupling 47 to be achieved.

The functional mode of the coupling 47 will be described hereunder, proceeding from the "manual" operative state in which there is no drive connection between the two belts 33, 43 and the upper rail tracks 13, and the sewing machine 19, respectively, and in which the two belts 33 and 43, respectively, are not pressed against the upper guide pins 69 by the lower retaining pin 71 (FIG. 4). The elements (sewing machine 19 and upper guide tracks 13) that are completely decoupled from the belts 33, 43 enable a substantially friction-free displacement of the sewing machine 19 on the guide tracks 9 and 13 in the X-direction and the Y-direction. The belts 33, 43 herein are not moved.

If quilting or lock-stitching in the automatic mode is now desired, it is inevitable that a friction-fitting or a form-fitting connection between the sewing machine 19 and the drive (belts 33, 43) of the upper guide tracks 9 and 13 has to be performed (FIGS. 2 and 3). For this purpose, a rotation movement of the disk 53 by 90° is performed, using the activation lever 55 on the housing 49 of the coupling 47, on account of which the lower retaining pin 71 deflects the belts 33 and 43, respectively, toward the top, a form-fitting connection in the case of a timing belt 33, 43, or a force-fitting connection between the belts and the coupling, or the elements that are fastened to the coupling 47, respectively, being consequently established. Quilting and lock-stitching may now be performed by way of a respective controller (controller not illustrated) in that the drive motors 31 and 39 initiate the X-movements and Y-movements of the sewing machine 19.

Should a finger, a hand, or an item of clothing make its way into the travel region of the sewing machine 19 and/or of the upper guide tracks 13 during automatic quilting, tangential forces that attempt to rotate the disk 53 counter to the resistance of the ball 59 which engages in the groove 57 act on the retaining pin 71. Upon exceeding a settable value at which the ball 59 is urged out of the groove 57, emergency triggering is performed by a rotation of the disk which as a result guides the lower retaining pin 71 away from the belts 33, 43 and consequently guides the belt 33, 43 in a manner freely displaceable in relation to the coupling 47. Consequently, the coupling 47, on the one hand, serves for coupling or connecting, respectively, the sewing machine 19 or the upper guide frame 13, respectively, to the belts 33, 43, and on the other hand serves as an overload protection from forces that act on these elements.

In order for work in the automatic mode being able to be resumed after the incident, the activation lever 55 is rotated back until the ball 59 latches into the groove 57 again and the belt 33, 43 is again fixedly connected to the coupling 47.

Figure 5:
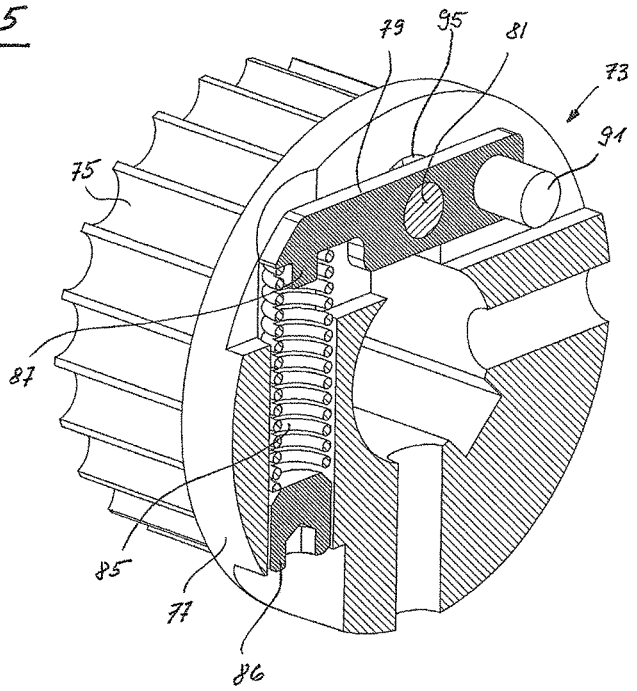
FIG. 5 shows a perspective sectional illustration of a belt pulley having an overload coupling flange-fitted thereto.
Figure 5A:
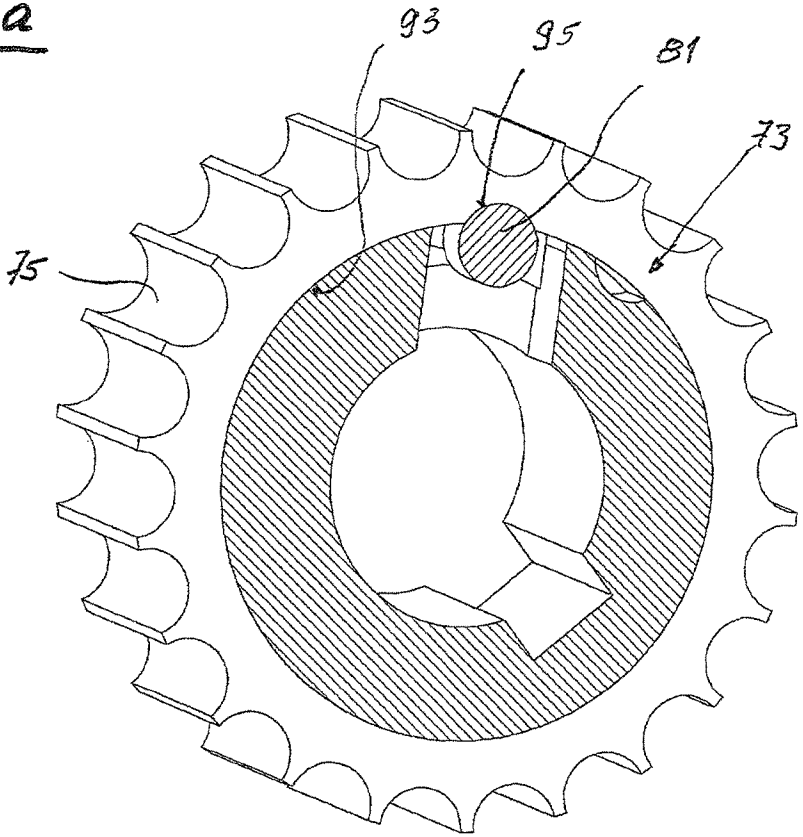
FIG. 5*a* shows a section through the overload coupling between the belt pulley and the flange housing.
Figure 6:
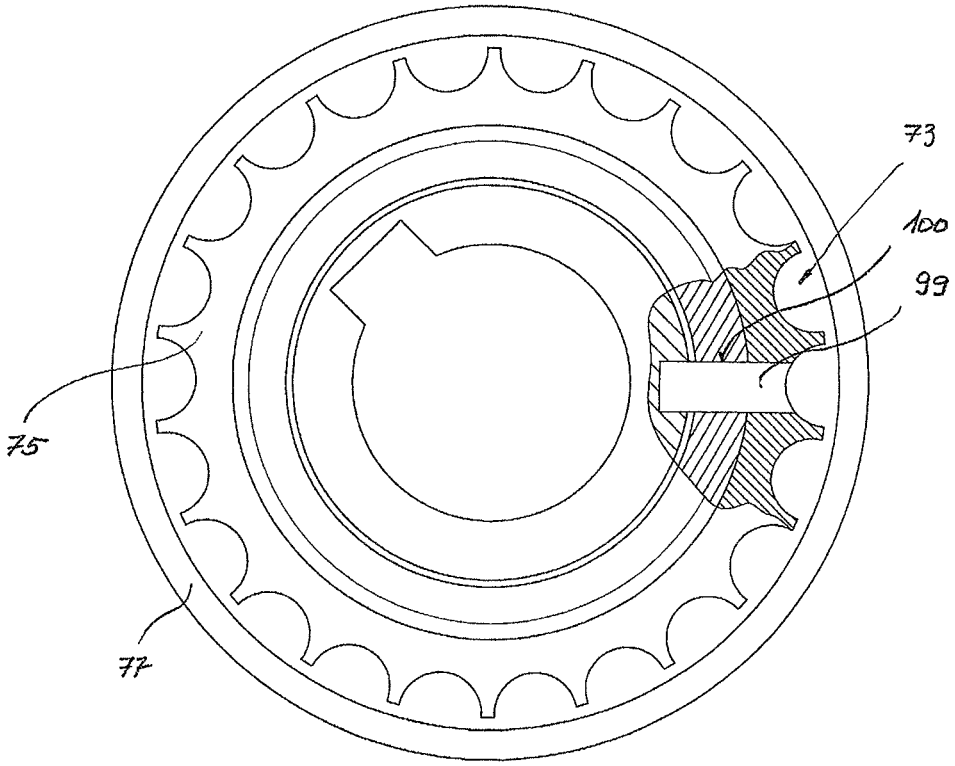
FIG. 6 shows a front view of the belt pulley having overload protection by way of a shear bolt.
Figure 7:
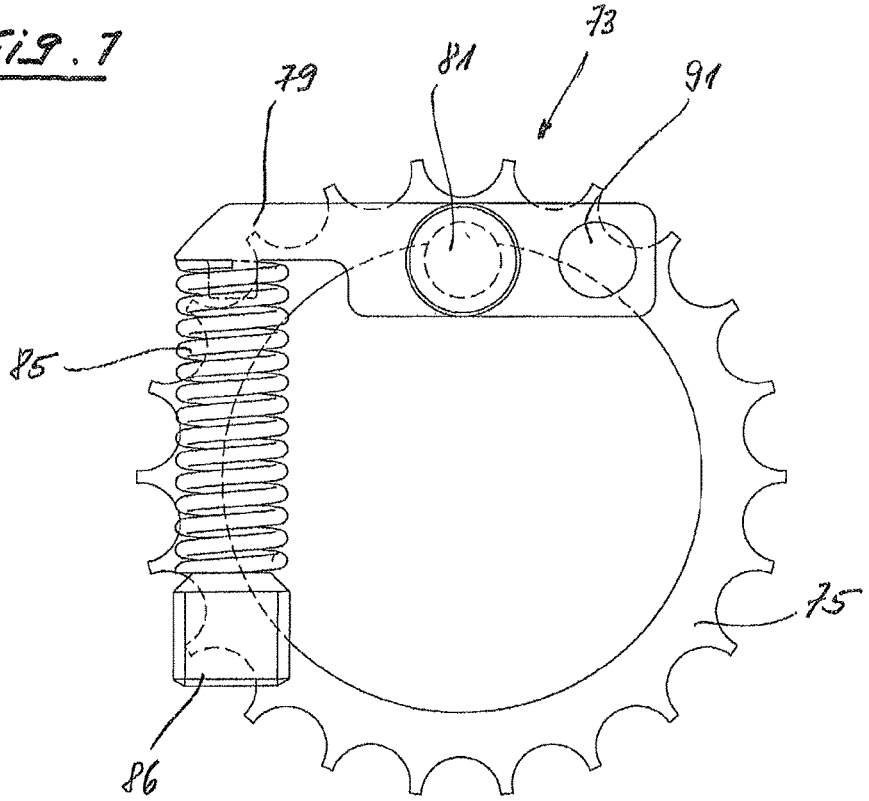
FIG. 7 shows a front view of the belt pulley and, in front thereof, of the pivot arm and of the coil spring.
Figure 8:
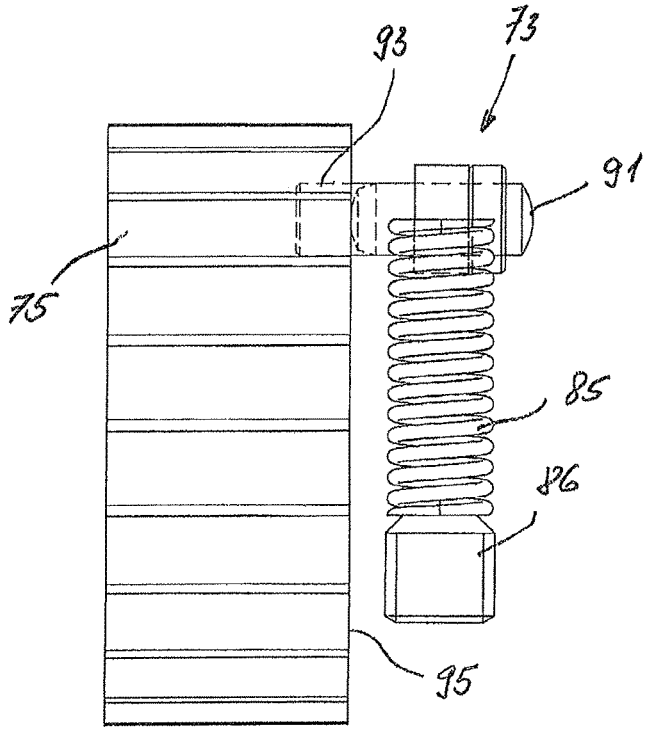
FIG. 8 shows a view of the belt pulley and of the pivot arm according to FIG. 7, from the direction of the arrow P.
Figure 9:
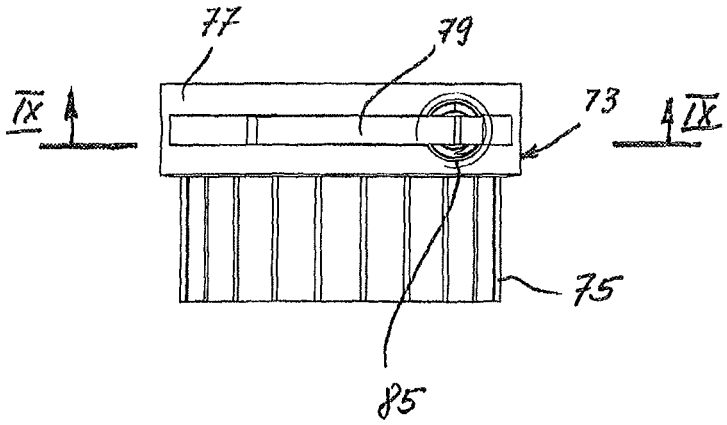
FIG. 9 shows a plan view of the belt pulley and of the dual-arm lever and the flange housing.
Figure 10:
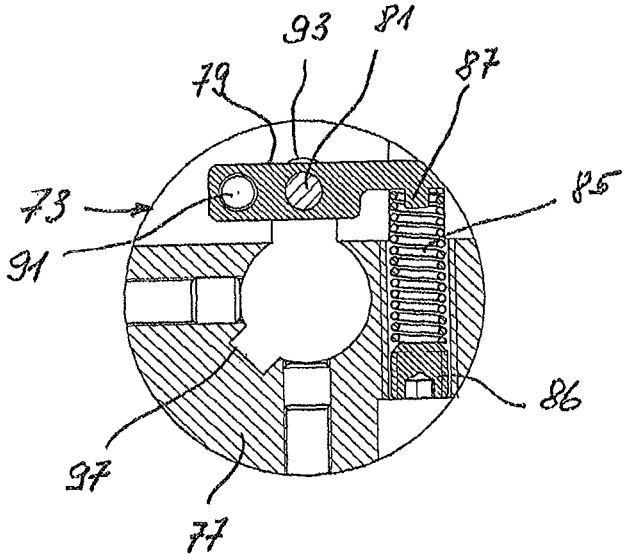
FIG. 10 shows a detailed view of the dual-arm lever in a sectional illustration along the line IX-IX in FIG. 9.

Alternatively or additionally to the coupling 47 which acts on the belts 33 and 43, respectively, in the further design embodiment of the invention according to FIGS. 5 and 6 an overload coupling 73 is disposed directly on a take-off sprocket 75 on the drive motors 31 and 39, respectively. The overload coupling 73 is accommodated in a disk-shaped flange housing 77 which is placed in a rotationally fixed manner onto the take-off shaft of the drive motor 31 or 39, respectively. The overload coupling 73 comprises a pivotable arm 79 which is mounted on a bolt 91 which is mounted on the flange housing 77. The arm 79 is supported on a coil spring 85 which is held and guided in the flange housing 77. The connection between the upper end of the coil spring 85 which is settable by way of a set screw 86, and the end of the arm 79 is performed by a retaining cam 87 that is disposed there. A latching pin 81 is inserted in the arm 79. The latching pin 81 engages in the axial direction into a depression 93 (depression 93 in the take-off sprocket 75) that has the shape of a segment of a circle (FIG. 5 and FIG. 5*a*).

By way of the form-fitting connection of the latching pin 81, the flange housing 77 which comprises the overload coupling 73 is coupled to the take-off sprocket 75, and the torque of the drive motor 31 or 39, respectively, is consequently transmitted via the flange housing 77 to the take-off sprocket 75 for the belts 33 and 43.

Should one of the belts 33 or 43, respectively, during the operation of the machine assembly 1 be decelerated by an object such as a finger, a hand, or an item of clothing, the tangential force acting on the latching pin 81 is increased in such a manner that the latter, counter to the force of the spring 85, is pushed out of the depression 93 and, on account thereof, the operative connection (torque transmission) between the flange housing 77 and the take-off sprocket 75 is interrupted. After the latching pin 81 has slid out of the depression 93, the arm 79 is pivoted counter to the force of the coil spring 85. The latching pin 81 thereafter slides on the internal face of a recess 95 on the take-off sprocket 75. The latching pin 81 may return into the depression only once there is no resistance acting on the belt 33, 43.

The connection of the flange housing 77 to the take-off shaft of the drive motor 31 or 39, respectively, is performed in a known manner by a key which engages in the keyway 97 on the flange housing 77.

In one further design embodiment of the coupling 73 (FIG. 6), a shear bolt 99 takes the place of the latching pin 81 or of a ball that is placed on top thereof. This shear bolt 99 ruptures when a load that causes the shear bolt 99 to rupture acts by way of the take-off sprocket 75 on the coupling. The shear bolt may be inserted directly in a bore 100 in the housing 77 and engage in a bore, aligned with said bore 100, in the sprocket 75.

If and when an overload coupling 73 according to FIGS. 5, 5*a*, and 6 is used, no coupling having an overload protection is required for the connection between the belts 33, 43 and the upper guide frame 11, or the sewing machine 19. In this instance, a coupling assembly which only enables parts that are connected by the coupling to be coupled or decoupled suffices.

Figure 11:
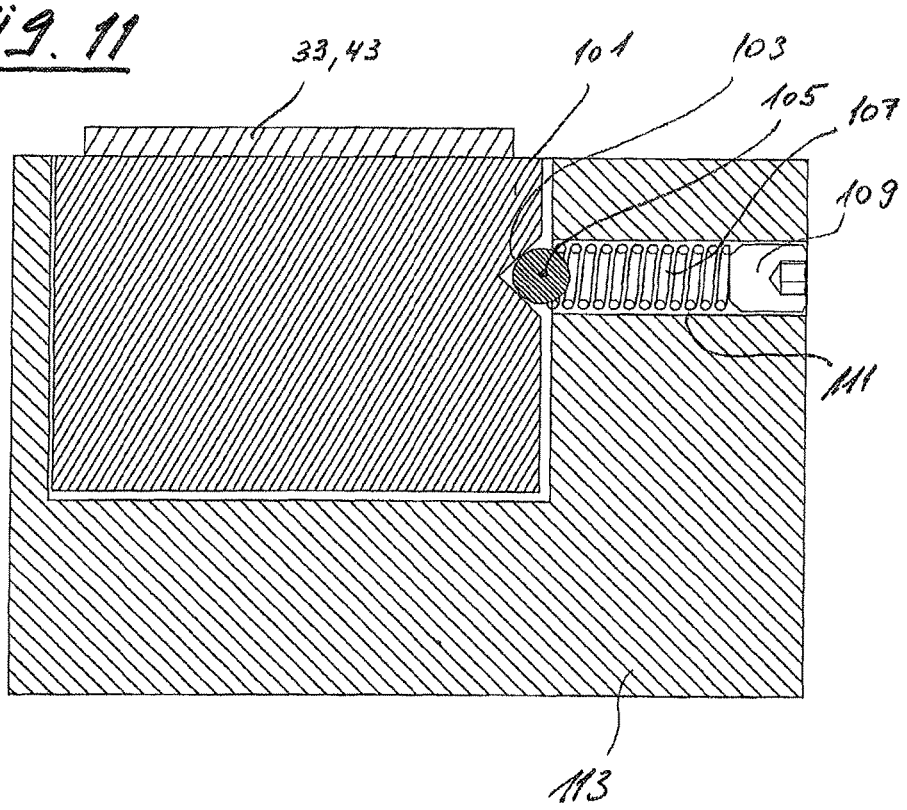
FIG. 11 shows a cross section through a further overload coupling on a belt.

FIG. 11 shows an overload coupling in a simple embodiment. A latching element 101 that is fastened to the belt 43 comprises laterally a clearance 103 in the shape of a conical or semi-spherical clearance in which a ball 105, or a bolt which is provided with a spherical tip and which is pretensioned by means of a spring 107, engages. The ball 105, or the resiliently mounted bolt, respectively, may be set by way of a set screw 109. The spring 107 sits in a bore 111 in a retaining element 113. The retaining element 113 is configured so as to be fastenable to the upper guide frame 13, or to the support 17, respectively.

Should one of the belts 33 or 43 be decelerated or stopped by an object, the ball 105 is lifted out of the clearance 103, and the form-fitting connection between the belt 33 or 43, respectively, and the travel-capable elements is interrupted.

LIST OF REFERENCE SIGNS

1 Lockstitch machine assembly
3 Framework
5 Support leg
7 Profiled elements
8 Lower guide frame
9 Rail track (lower)
11 Upper guide frame
13 Upper rail track
15 Rollers
17 Support
19 Sewing machine
21 Arm bed
23 Machine pedestal
25 Machine head
27 Needle bar
29 Needle-hole plate
31 First drive motor
33 First belt
35 Covering hood
37 End profiles
39 Second drive motor
41 Covering hood
43 Upper belt
45 Safety cover
47 Coupling
49 Housing
51 Bore
53 Cylindrical disk
55 Activation lever
57 Groove
59 Ball
61 Spring
63 Guide bore
65 Set screw
67 Threaded portion
69 Guide pin
71 Retaining pin
73 Overload-protection coupling
75 Take-off sprocket
77 Flange housing
79 Dual-arm lever
81 Latching pin

85 Coil spring
86 Set screw
87 Retaining cam
91 Bolt
93 Depression
95 Recess
97 Keyway
99 Shear bolt
100 Bore
101 Latching element
103 Clearance
105 Ball
107 Spring
109 Set screw
111 Bore
113 Retaining element

The invention claimed is:

1. A long arm quilt and lockstitch machine assembly, comprising a framework having two orthogonally running rail tracks, disposed on top of one another, the rail track lying above is mounted on the rail track lying below so as to be displaceable in a translatory manner, a sewing machine located so as to be displaceable on the rail track lying above, the rail track lying above and the sewing machine that is displaceable thereon each being drivable by a respective motor, and connection elements between the motors and the upper rail track and the sewing machine, respectively, are configured so as to be couplable and decouplable, at least one of the connection elements comprises at least one coupling which releases in response to a motor overload and by which at least one of the upper rail track or the sewing machine is mechanically separable from the respective motor, wherein the at least one coupling is disposed on at least one of the motors or on a conveyor element, the at least one coupling comprises at least one overload-protection coupling connectable to a take-off sprocket in order to drive the conveyor element, the overload-protection coupling comprises a flange housing in which a latching pin, that is disposed on an arm of a lever, on an end side thereof is latchable into the take-off sprocket, forming a form-fitting connection between at least one of the motors and the take-off sprocket.

2. The long arm quilt and lockstitch machine assembly as claimed in claim 1, wherein a spring by which the latching pin is held in the form-fitting connection to the take-off sprocket engages on the arm of the lever.

3. A long arm quilt and lockstitch machine assembly, comprising a framework having two orthogonally running rail tracks, disposed on top of one another, the rail track lying above is mounted on the rail track lying below so as to be displaceable in a translatory manner, a sewing machine located so as to be displaceable on the rail track lying above, the rail track lying above and the sewing machine that is displaceable thereon each being drivable by a respective motor, and connection elements between the motors and the upper rail track and the sewing machine, respectively, are configured so as to be couplable and decouplable, at least one of the connection elements comprises at least one coupling which releases in response to a motor overload and by which at least one of the upper rail track or the sewing machine is mechanically separable from the respective motor, wherein the at least one coupling comprises a housing which is connected to the rail track or to the sewing machine, and in which a cylindrical disk is rotatably mounted in a bore, an activation lever is connected to a first end side of the disk, and a retaining pin is placed onto a second end side of the disk, and two laterally spaced-apart guide pins are fastened to the housing above the disk.

4. The long arm quilt and lockstitch machine assembly as claimed in claim 3, wherein axes of the two guide pins and of the retaining pin in an operative position and in the case of a closed coupling lie so as to be disposed approximately on a straight line, wherein a belt that is routed between the guide pins and the retaining pin and that functions as a conveyor element is actuatable and blockable by the retaining pin.

5. The long arm quilt and lockstitch machine assembly as claimed in claim 4, wherein the retaining pin in the case of overloading by way of a force of the belt that acts tangentially on the disk, is displaceable from a blocking and retaining position to a freewheeling position of the belt by rotating the disk.

6. The long arm quilt and lockstitch machine assembly as claimed in claim 4, wherein the belt by rotating the disk by way of the lever is connectable to or releasable from the disk by way of the retaining pin.

* * * * *